US011186467B2

(12) United States Patent
Backes et al.

(10) Patent No.: US 11,186,467 B2
(45) Date of Patent: Nov. 30, 2021

(54) CRANE WITH HOISTING CABLE LOAD-DEPENDENT LOAD TORQUE EQUALIZATION

(71) Applicant: MANITOWOC CRANE GROUP FRANCE SAS, Dardilly (FR)

(72) Inventors: Bernd Backes, Oberthal (DE); Frank C. Schnittker, Wurzburg (DE)

(73) Assignee: MANITOWOC CRANE GROUP FRANCE SAS, Dardilly (FR)

( * ) Notice: Subject to any disclaimer, the term of this patent is extended or adjusted under 35 U.S.C. 154(b) by 142 days.

(21) Appl. No.: 16/475,660

(22) PCT Filed: Dec. 22, 2017

(86) PCT No.: PCT/EP2017/084554
§ 371 (c)(1),
(2) Date: Jul. 2, 2019

(87) PCT Pub. No.: WO2018/127439
PCT Pub. Date: Jul. 12, 2018

(65) Prior Publication Data

US 2019/0367339 A1 Dec. 5, 2019

(30) Foreign Application Priority Data

Jan. 3, 2017 (DE) ..... 10 2017 100 046

(51) Int. Cl.
*B66C 23/76* (2006.01)
*B66C 23/10* (2006.01)
(Continued)

(52) U.S. Cl.
CPC ..... *B66C 23/76* (2013.01); *B66C 23/10* (2013.01); *B66C 23/42* (2013.01); *B66C 23/50* (2013.01);
(Continued)

(58) Field of Classification Search
CPC .... B66C 2700/0314; B66C 2700/0378; B66C 23/10; B66C 23/42; B66C 23/50; B66C 23/72; B66C 23/74; B66C 23/76
See application file for complete search history.

(56) References Cited

U.S. PATENT DOCUMENTS 1,344,659 A * 6/1920 Sjoberg ..... B66C 23/72 212/196
2,408,500 A * 10/1946 West ..... B66C 23/76 212/196
(Continued)

FOREIGN PATENT DOCUMENTS

DE 283876 C 4/1915
DE 436668 A 11/1926
(Continued)

OTHER PUBLICATIONS

English translation of DE283876 (Year: 2021).*
(Continued)

*Primary Examiner* — Sang K Kim
*Assistant Examiner* — Nathaniel L Adams
(74) *Attorney, Agent, or Firm* — Patent Law Works, LLP; Craig Buschmann

(57) ABSTRACT

A crane includes a jib which is mounted on the crane structure so as to be rotatable about a bearing point, a counterweight arrangement which can be positioned variably in relation to the bearing point, and a hoisting cable which runs out from a hoisting winch and is guided via the jib. A counterweight adjustment device, which is coupled to the counterweight arrangement, includes
a lever element mounted rotatably about a pivot point,
a hoisting cable guide arranged in the course of the hoisting cable between the hoisting winch and an upper jib section, with a first deflecting pulley arrangement mounted on the jib and a second deflecting pulley arrangement mounted on the
(Continued)

lever element, wherein the hoisting cable is guided in an alternating manner via the first and the second deflecting pulley arrangement, and a coupling element acting on the lever element and connected to the counterweight arrangement.

17 Claims, 4 Drawing Sheets

(51) Int. Cl.
*B66C 23/42* (2006.01)
*B66C 23/50* (2006.01)

(52) U.S. Cl.
CPC ..... *B66C 2700/0314* (2013.01); *B66C 2700/0378* (2013.01)

(56) References Cited

U.S. PATENT DOCUMENTS 3,266,636 A * 8/1966 Russell ..... B66C 23/76 212/196
6,568,547 B1 5/2003 Kretschmer et al.

FOREIGN PATENT DOCUMENTS

DE 557993 C * 8/1932 ..... B66C 23/10
DE 7232092 U 11/1973
DE 2917829 A1 11/1980
FR 1413966 A * 10/1965 ..... B66C 23/72

OTHER PUBLICATIONS

German Search Report and Written Opinion dated Oct. 19, 2017 for corresponding German Patent Application No. 102017100046.1.
International Preliminary Report on Patentability dated Apr. 11, 2019 for corresponding PCT/EP2017/084554.
International Search Report and Written Opinion dated Jul. 12, 2018 for corresponding PCT/EP2017/084554.

* cited by examiner

CRANE WITH HOISTING CABLE LOAD-DEPENDENT LOAD TORQUE EQUALIZATION

REFERENCE TO EARLIER FILED APPLICATIONS

The present patent application is a 371 National Phase application of PCT/EP2017084554 filed on Dec. 22, 2017 and entitled Crane With Hoisting Cable Load-Dependent Load Torque Equalization, which in turn claims the priority of German Patent Application DE 10 2017 100 046.1, filed Jan. 3, 2017, pursuant to 35 U.S.C. 119(a)-(d), the contents of each are incorporated by reference in their entirety as if fully set forth herein.

FIELD OF THE INVENTION

The present invention relates to a crane, in particular to a mobile crane with load torque equalization, which varies the position of the crane counterweights depending on the hoisting cable load and therefore provides hoisting cable load-dependent load torque equalization. According to the invention, the mechanical principles of the gearing effect are correlated with to those of a mechanical balancer.

BACKGROUND OF THE INVENTION

Cranes having a variable counterweight position are already known, for example, from DE 198 57 779 and, in comparison to cranes having a fixed counterweight arrangement, have the advantage that the torque generated by the counterweights can be varied at all times and with relatively little effort. For example, load torque equalization can be flexibly provided to the desired level even during operation of a crane. However, a problem already known in the case of cranes having a fixed counterweight arrangement also continues to exist in the case of these cranes: in particular during sudden lifting and depositing of relatively large loads, abrupt changes in the counter torque provided by the counterweights occur, which have to be reacted to within a very short time. Thus, during the sudden, frequently unintentional depositing of a high load, there is the risk of the crane tipping rearward because of the counterweights which at this time have been extended rearward. Conversely, during the raising of a very high load, care has to be taken to ensure that the counterweights have been extended rearward to an extent so as to prevent tipping of the crane forward.

SUMMARY OF THE INVENTION

It is an object of the present invention to improve variable load torque equalization, as described at the beginning, of a crane in such a manner that it reacts individually to different load situations and therefore undesirable operating states of the crane can also be avoided.

This object is achieved by a crane according to the invention. Preferred embodiments of the present invention are the subject matter of the dependent claims.

The crane according to the invention comprises a jib which is mounted on the crane structure so as to be rotatable about a bearing point, a counterweight arrangement which can be positioned variably in relation to the bearing point, a hoisting cable which runs out from a hoisting winch and is guided via the jib, and a counterweight adjustment device which is coupled to the counterweight arrangement for the variable positioning of the counterweight arrangement depending on the hoisting cable load. The counterweight adjustment device here comprises

- a lever element which is mounted rotatably about a pivot point, which is arranged on the crane structure rearwardly with respect to the jib,
- a hoisting cable guide which is arranged in the course of the hoisting cable between the hoisting winch and an upper jib section, having a first deflecting pulley arrangement which is mounted on the jib and a second deflecting pulley arrangement which is mounted on the lever element, wherein the hoisting cable is guided in an alternating manner via the first and the second deflecting pulley arrangement,
- a coupling element which acts on the lever element and is connected to the counterweight arrangement.

In other words, according to the present invention, a mechanism is therefore provided via which the hoisting cable of the crane is incorporated into the device for adjusting the counterweight position. A first essential element of the counterweight adjustment device according to the invention is formed by a lever mounted rotatably on the crane, also called balancer below, from the pivot point of which two lever arms extend. While one of the lever arms is coupled to the counterweight arrangement, the other lever arm is coupled to the jib via at least one cable loop formed by the hoisting cable of the crane. In order to form the at least one cable loop, one or more cable pulleys are arranged both on the jib and on the lever arm of the balancer, via which cable pulleys the hoisting cable running out from the hoisting winch of the crane is guided in an alternating manner in order subsequently to be guided further via the crane jib tip. Like the balancer, the jib is also mounted rotatably on the crane structure, and therefore the distance between the cable pulleys on the jib and the cable pulleys on the balancer can be varied by the hoisting cable being acted upon with a load. According to the invention, said deflection of the balancer that is brought about by the hoisting cable load is transmitted to the counterweight arrangement in such a manner that an increase in the load on the hoisting cable leads to a substantially rearwardly directed change in position of the counterweights. Conversely, a reduction in the hoisting cable load brings about a substantially forwardly directed change in position of the counterweights.

Accordingly, the present invention makes it possible with mechanical means to fully automatically adapt the load torque equalization to the cable force currently exerted on the hoisting cable by the load. The frictional forces and inertia forces immanent in the mechanism reduce swinging upward of the system to an extent that dynamic oscillations are avoided. Frictional forces could optionally additionally be increased in the system.

The counterweight adjustment device according to the invention can firstly be used in mobile cranes which have a crane superstructure which is mounted rotatably on a crane truck and in which the jib is mounted on the crane superstructure so as to be rotatable about a bearing point. Secondly, the counterweight adjustment device according to the invention can also be used in the case of stationary or semi-stationary cranes, for example in the case of platform cranes or ringlift cranes. Use of the counterweight adjustment device according to the invention in the case of what is referred to as a superlift crane is also possible with modifications, wherein only embodiments in which the superlift mast is at a fixed angle in relation to the crane structure and the superlift counterweight is axially connected to the variable counterweight in a length- and force-variable manner, in order to avoid a mutual swinging motion of, or even interference between, superlift counterweight and counterweight, are suitable here.

According to a first embodiment of the present invention, the lever element or the balancer is mounted rotatably on a stay rack via which the crane jib is ultimately braced. In the case of such a crane, the bracing between the stay rack and the jib is invariable in length, and therefore the jib and the stay rack enclose a fixed angle between each other. The tilting in and out of the jib accordingly takes place during simultaneous rotation of the stay rack relative to the crane structure.

On the other hand, according to a second embodiment, the lever element or the balancer can also be coupled about a pivot point which is positionally fixed relative to the crane structure, for example to a bracket belonging to the crane superstructure. This permits variable positioning of the jib relative to the stay rack which can therefore take up a fixed position relative to the crane structure or the crane superstructure during the tilting in and out of the jib. It would thus basically also be conceivable for the hoisting cable which is guided between the jib and the balancer to partially or even entirely take on the function of the jib stay by said hoisting cable absorbing the bracing forces which are conventionally absorbed by a jib stay.

On the other hand, it is also conceivable for a conventional, length-variable jib stay to be provided between the jib and the stay rack.

As has already been explained at the beginning, the lever element can have lever arms which are arranged fixedly with respect to one another and are coupled to the deflecting pulley arrangement for the hoisting cable or to the counterweight arrangement. Said lever arms can have any desired length ratio with respect to one another, with the lever arms also being able to extend at any desired angles with respect to one another from the common pivot point. However, in a move away from a classic "balancer", other configurations of the lever element are also conceivable. For example, it is also conceivable for the lever element to be formed by a pinion which engages on opposite sides in two racks, which are displaceable in a translatory manner and parallel to each other and which are coupled in turn to the deflecting pulley arrangement or to the counterweight arrangement. This special case of a lever element consequently likewise has two lever arms which always lie opposite and are identical in length, but the position of which with respect to the lever element itself is variable. Hydraulic activations via balancer-coupled cylinders, which are coupled hydraulically or to one another in force- and length-variable ratios via levers, are also conceivable in order, in addition to the change in length of the hoisting cable reeving, also to introduce changes in force between the hoisting cable side and the balancer side. It thus becomes clear that the lever element in the present invention is not restricted to a simple balancer but rather also comprises identically acting elements for mechanically transmitting and conducting force.

The coupling element coupling the counterweight arrangement to the lever element is advantageously configured in such a manner that it can transmit compressive forces between the lever element and the counterweight arrangement, wherein it is furthermore preferably designed as a pendulum support.

In addition, the crane according to the invention can have a device by means of which the counterweight arrangement is guided on the crane structure, in particular on the crane superstructure, during the forward retraction and rearward extension. In a specific configuration, the guide device can have a rail which is guided along running rollers of the crane structure and the rearward end of which is coupled to the counterweight arrangement. In particular, said guide rail can also have a curvature, and therefore, during the rearward extension of the counterweight arrangement, the latter is additionally also raised in the vertical direction and, as a result, an additional change in the potential energy of the counterweight arrangement is brought about. This creates a system-immanent energy store, the energy of which can be used for pivoting back the counterweight arrangement to a location which lies closer to the center point of rotation of the crane superstructure.

As an additional functional advantage, the friction pairings in the mechanism could be designed according to the invention in such a manner that said system-immanent frictional forces, in conjunction with system-immanent inertia forces, influence swinging upward of the system to an extent to avoid dynamic oscillations between the hoisting cable deflections, the deflection shifting means and the counterweight deployment mechanism, or a friction-affected guide of the latter.

The present invention will now be explained in more detail using preferred embodiments and with reference to the attached figures. It can comprise all of the features described below individually and in any meaningful combination.

DETAILED DESCRIPTION

Figure 1:
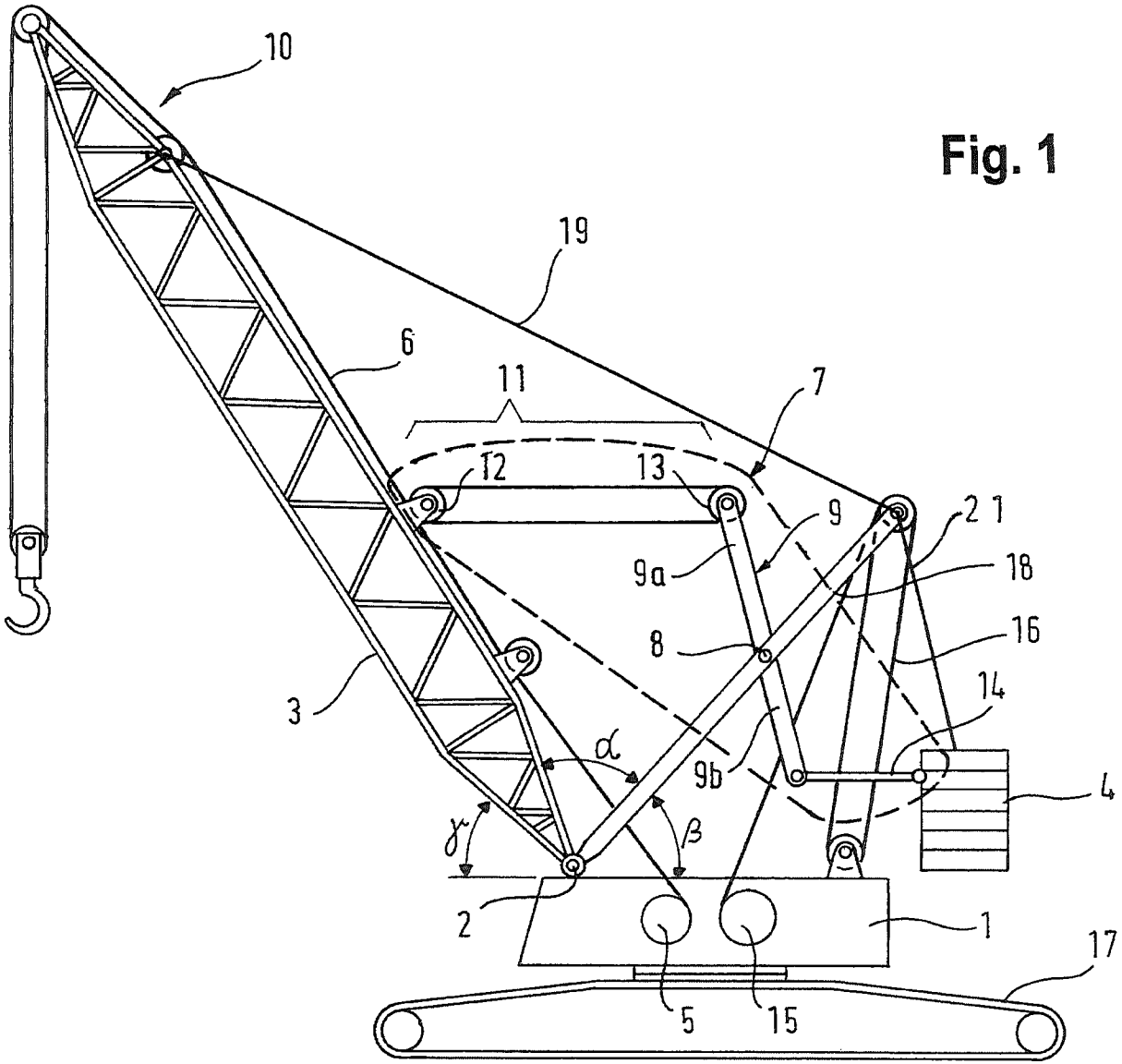
FIG. 1 shows a first embodiment of a mobile crane according to the invention.

The mobile crane according to a first embodiment that can be seen in FIG. 1 has a crane truck 17 having a crawler track, wherein a crane superstructure 1 is mounted on the crane truck 17 so as to be rotatable about a vertical axis. A hoisting winch 5 and a retracting winch 15, from which a hoisting cable 6 and a cable for the retraction mechanism 16 respectively extend, are arranged inter alia on the superstructure 1.

Furthermore, a lattice jib 3 is connected to the crane superstructure 1 so as to be rotatable via the bearing point 2, and therefore said lattice jib can be tilted down (the angle $\gamma$ enclosed between the jib 3 and the horizontal plane running through the crane superstructure 1 is reduced) and up ($\gamma$ is increased). The tilting of the jib 3 down and up is brought about, in the embodiment shown in FIG. 1, by the fact that the cable of the retraction mechanism 16 is unwound from, or wound up by, the retraction winch 15 and, as a result, that end of the stay rack 18 which is remote from the bearing point 2 is moved away from the crane superstructure 1 or toward the crane superstructure 1. Since the jib stay 19 extending in between the tip 10 of the jib 3 and the tip of the stay rack 18 has a fixed length, the angle $\alpha$ enclosed between the jib 3 and the stay rack 18 remains constant while the angle $\beta$ enclosed between the stay rack 18 and the horizontal plane running through the superstructure 1 has a variable value, complementary to the angle $\gamma$.

A counterweight arrangement 4 is provided in the rearward region of the superstructure 1, said counterweight arrangement being braced by the tip of the stay rack 18 and therefore counteracting a tilting moment about the bearing point 2 that is caused by the jib 3 and a load which may be suspended thereon.

In order to be able to vary the position of the counterweight arrangement 4 relative to the bearing point 2 and therefore the generated load equalization torque, in the embodiment of the crane according to the invention that can be seen in FIG. 1, a lever element 9 is connected to the stay rack 18 at a pivot point 8 so as to be rotatable about a horizontal axis. A first lever arm 9*a* of the lever element 9 is coupled to the jib 3 by the fact that the hoisting cable 6 running out from the hoisting winch 5 is guided in an alternating manner via a first deflecting pulley arrangement 12 arranged on the jib 3 and a second deflecting pulley arrangement 13 arranged on the lever arm 9*a* before said hoisting cable is guided further via the jib tip 10 to a hook block (not denoted specifically). The lever arm 9*b* lying opposite the lever arm 9*a* is coupled to the counterweight arrangement 4 via a pendulum support 14.

It can be understood with reference to FIG. 1 that acting upon the hoisting cable 6 with a load (not shown in FIG. 1) brings about a change in length of the hoisting cable guide 11, specifically depending on the reeving of the hoisting cable 6, in accordance with the number of deflecting pulleys provided for the arrangements 12 and 13. In other words, the hoisting cable guide 11 acts as a block and tackle, and therefore the lever arm 9*a* is rotated toward the jib 3 depending on the cable load. Conversely, a rearwardly directed shifting of the position of the counterweight arrangement 4 is thereby brought about since the lever arm 9*b* which is coupled to the counterweight arrangement 4 via the pendulum support 14 also rotates about the pivot point 8. As soon as the counterweight arrangement 4 is moved rearward, it is also raised by a certain amount in the vertical direction because of its length-invariable suspension on the tip of the stay rack 18. By means of the change in the potential energy of the counterweight arrangement 4, in addition to the increase in the load equalization torque with respect to the axis of rotation of the crane superstructure, a resetting torque is also generated which attempts to move the counterweight arrangement 4 in a forward direction again into a position of lower potential energy. A reduction in the cable force in the hoisting cable 6 conversely leads to the counterweight arrangement 4 being moved in a forward direction again.

Since the stay rack 18 and the jib 3 enclose a constant angle $\alpha$, the mechanism of the counterweight adjustment device 7 remains uninfluenced by the size of the tilting angle $\gamma$.

The use of the stay rack 18, which is already structurally provided, as a coupling point for the lever element 9 brings about the advantage of a compact construction of the crawler crane, in particular with respect to the rearward slewing radius of the counterweight arrangement 4. In the embodiment which can be seen in FIG. 1, only the hoisting cable force has a direct influence on the size of the arising counterweight radius if the angle $\beta$ remains unchanged. The counterweight radius thus arises virtually automatically in a mechanical way corresponding to the hoisting cable force which is present. Actuators and sensors controlled in a complicated manner can thereby be dispensed with apart from the use of displacement sensors, position indicators, load cells or a cable metering means.

Figure 2:
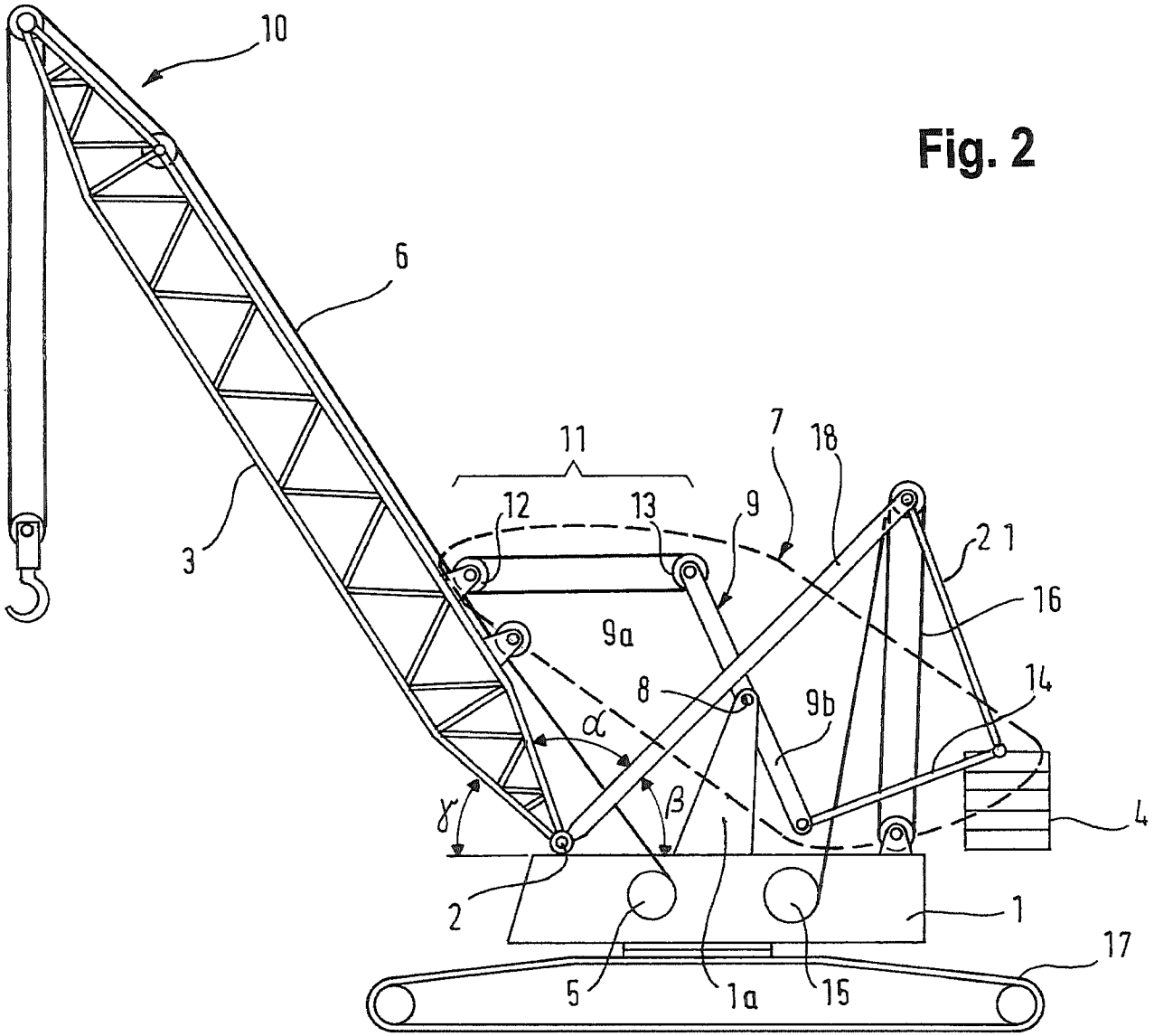
FIG. 2 shows a second embodiment of a mobile crane according to the invention.

FIG. 2 shows a further embodiment of the crane according to the invention which differs from the crane shown in FIG. 1 essentially only by means of a different embodiment of the counterweight adjustment device 7. The lever element 9 is now arranged rotatably about a fixed point relative to the crane superstructure 1, by said lever element being mounted about a pivot point 8 on a bracket 1*a* of the crane superstructure 1. This has the result that, even a load torque which is variable by tilting of the jib 3 can be equalized in a variable manner by the counterweight arrangement 4. The position of the counterweight arrangement 4 is thus not only dependent on the hoisting cable load, but also on the load radius or on the tilting angle $\gamma$.

In the case shown in FIG. 2, the jib stay 19 present in the crane from FIG. 1 can thus also be omitted since the bracing forces are now produced via the hoisting cable loop(s) formed between the deflecting pulley arrangements 12 and 13, and via the lever element 9, the pendulum support 14, the stay (21) of the counterweight arrangement 4 on the stay rack tip, and the stay rack 18. It should be noted in this connection that the stay (21) coupling the stay rack tip to the counterweight arrangement 4 has to be designed in such a manner that it can transmit compressive forces. It is likewise possible for a conventional jib stay to be provided, but this has to be force- and length-variable, in contrast to the length-invariable stay 19 from FIG. 1, since, during the tilting of the jib 3, the angle $\beta$ remains constant while the angle $\alpha$ is variable. For this purpose, the retraction winch 15 uses the retraction mechanism 16 in the event of the tilting up to pull the stay rack 18 in the direction of the crane superstructure 1 or let same out in the direction of the main jib 3 in the event of the tilting down. A rearward force- and length-variable stay of the stay rack 18 would also be conceivable, which can comprise, for example, a cylinder which brings about a change in force and length.

In the event of hoisting, the tilting up or down of the jib 3 changes the resultant force in the force triangle formed by the stay rack 18, the lever element 9 and the pendulum support 14. In order to produce a horizontal load equalization, and therefore equilibrium between the load side and counterweight side, via the lever element 9, the counterweight arrangement 4 is further deflected. In other words, by means of a stronger force resulting from the hoisting cable force and the stay rack adjustment, a heavy counterweight arrangement 4 can thus be brought onto a greater counterweight radius.

The function of the embodiment shown in FIG. 2 will be outlined briefly below: the load lying on the ground is raised by means of the hoisting cable 6. The load in the hoisting cable 6 increases in the process. Via the hoisting cable loop 11, the force then also acts on the lever element 9 and, by means of the pendulum support 14, pushes the counterweight arrangement 4 rearward, increasing the counterweight radius in the horizontal direction. At the same time, the counterweight arrangement 4 is raised in the circular arc of its suspension, which generates a resetting force in the lever element 9 via the pendulum support 14. If the force in the hoisting cable loop 11 and the force from the linear and/or arcuated adjustment of the counterweight radius are in balance, the load torque being introduced to the structurally defined ratio of the force triangle of stay rack 18, lever element 9, counterweight stay and pendulum support 14, i.e. the counterweight torque, is equalized. The overall system behaves mechanically virtually like a balancer with horizontal load equalization. The depositing of the load proceeds in reverse. Gravity pulls the counterweight arrangement 4 back into its starting position again in proportion to the slackening hoisting cable force in the hoisting cable loop 11 by means of the lever element 9.

Figure 3:
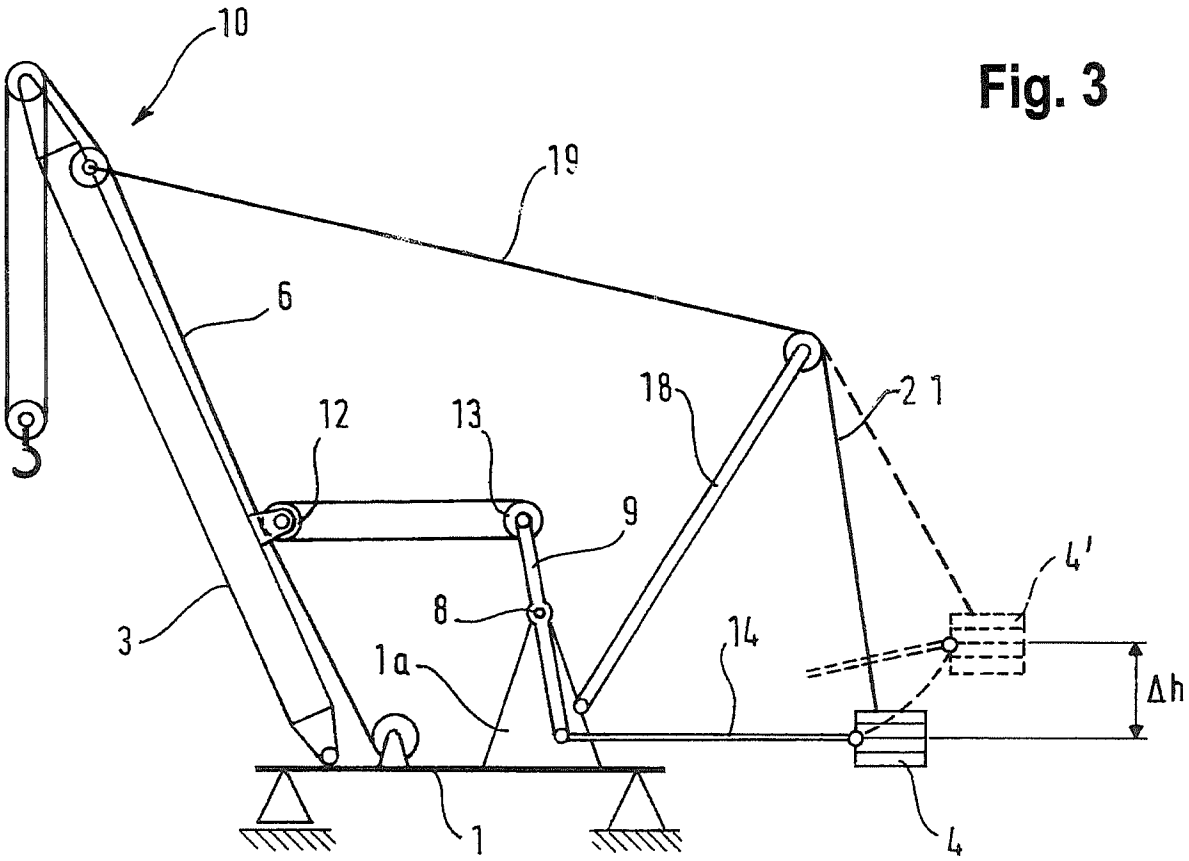
FIG. 3 shows a first embodiment of a stationary crane according to the invention.
Figure 4:
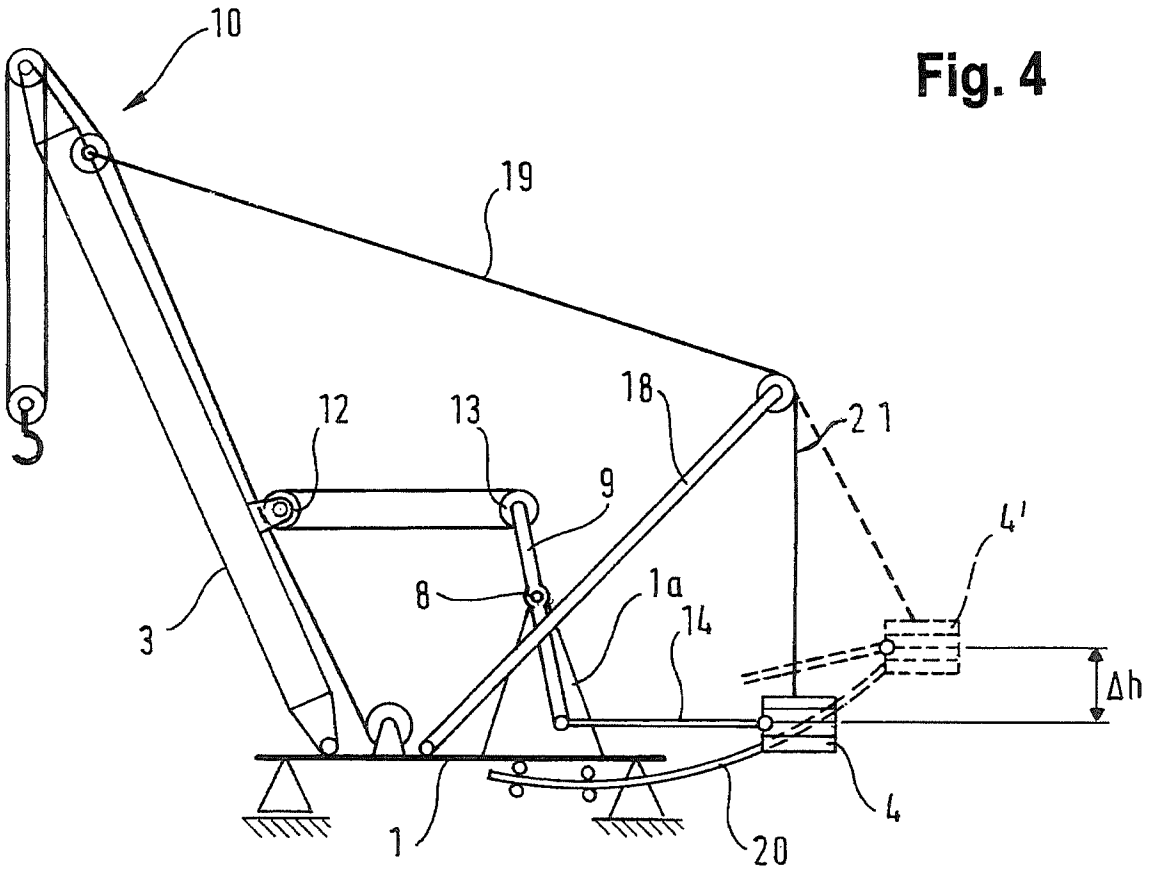
FIG. 4 shows a second embodiment of a stationary according to the invention.

FIGS. 3 and 4 show stationary cranes, the lever element of which, as in the case of the crane from FIG. 2 is likewise coupled to a bracket 1*a* of the crane structure 1. While, in the case of the crane from FIG. 3, the counterweight arrangement 4 is carried by the stay rack 18, on the tip of which said counterweight arrangement is suspended, as already in the case of the cranes from FIGS. 1 and 2, the crane from FIG. 4 additionally has a guide 20 for the counterweight 4. Said guide 20 comprises an arcuate guide rail which is coupled to the counterweight arrangement 4 and is guided on the crane structure by means of running rollers (not denoted specifically). The guide 20 provides an additional safety function in relation to the embodiment shown in FIG. 3. Thus, for example, in the case of a spontaneous "tearing off" of the lifting load, the counterweight arrangement 4 can be guided back in a controlled manner into a position with a lower counterweight torque, while simultaneously avoiding an undamped overswinging of the counterweights 4 suspended on the stay rack tip. For this purpose, the guide 20 can have damping, for example frictional damping between two components moving relative to each other. It can readily be seen both in FIG. 3 and in FIG. 4 that, in the rearwardly deflected state, the counterweight arrangement 4 has a higher level of potential energy which is dissipated when the counterweight arrangement 4 is retracted again in the direction of the rotational center of the crane.

The invention claimed is:

1. A crane comprising:

a. a jib which is mounted on a crane structure so as to be rotatable about a horizontal axis at a bearing point, b. a counterweight arrangement which can be positioned variably in relation to the bearing point, c. a hoisting cable which runs out from a hoisting winch and is guided via the jib, d. a counterweight adjustment device which is coupled to the counterweight arrangement for variably positioning the counterweight arrangement depending on a hoisting cable load, comprising i. a lever element which is mounted rotatably about a pivot point, which is arranged on the crane structure rearwardly with respect to the jib, ii. a coupling element which connects between the lever element and the counterweight arrangement, wherein e. two lever arms extend from the pivot point of the lever element, and the lever element is designed as a balancer, f. the counterweight adjustment device includes a hoisting cable guide which is arranged in a course of the hoisting cable between the hoisting winch and an upper jib section, having a first deflecting pulley arrangement which is mounted on the jib and a second deflecting pulley arrangement which is mounted on the lever element, wherein the hoisting cable is reeved multiple times in the first and the second deflecting pulley arrangement, and therefore a deflection, induced by the hoisting cable load, of the lever element is transmitted to the counter weight arrangement in such a manner that an increase of the hoisting cable load brings about a rearwardly directed change in position and a reduction in the hoisting cable load brings about a forwardly directed change in the position of the counter weight arrangement.

2. The crane as claimed in claim 1, wherein the crane is a mobile crane, with a crane superstructure which is mounted rotatably on a crane truck, and wherein the jib is mounted on the crane superstructure so as to be rotatable about the bearing point.

3. The crane as claimed in claim 2, wherein the lever element is mounted rotatably directly on a bracket belonging to the crane superstructure.

4. The crane as claimed in claim 3, wherein the jib is braced via the hoisting cable guide, wherein an angle ($\alpha$) between the jib and a stay rack arranged on the crane superstructure is variable and an angle ($\beta$) between the stay rack and the crane superstructure is invariable.

5. The crane as claimed in claim 1, wherein the jib is a lattice jib.

6. The crane as claimed in claim 1, further comprising a stay rack which is mounted rotatably on the crane structure, wherein the lever element is mounted rotatably on the stay rack.

7. The crane as claimed in claim 6, wherein the stay rack takes up a fixed angle (a) relative to the jib and a variable angle ($\beta$) with respect to a crane superstructure, and wherein a length-invariable jib stay extends between the jib and the stay rack.

8. The crane as claimed in claim 6, wherein the stay rack is mounted rotatably on a crane superstructure.

9. The crane as claimed in claim 1, wherein the lever element has a first lever arm which extends from the pivot point and on which the second deflecting pulley arrangement is mounted, and a second lever arm which extends from the pivot point and on which the coupling element acts.

10. The crane as claimed in claim 9, wherein the first and the second lever arm extend and move in opposite directions.

11. The crane as claimed in claim 10, wherein a counterweight guide is guided on a crane superstructure during the forwardly directed change in position of the counter weight arrangement and the rearwardly directed change in position of the counterweight arrangement.

12. The crane as claimed in claim 10, wherein a counterweight guide is guided in such a manner that, during the rearwardly directed change in position of the counterweight arrangement, the counterweight arrangement is raised in the vertical direction.

13. The crane as claimed in claim 12, wherein at least one coupling of two or more elements of the counterweight adjustment device comprises one or more members adapted to dampen a motion of the two or more elements with respect to each other by increasing friction between the two or more elements.

14. The crane as claimed in claim 1, wherein the coupling element is configured to transmit compressive forces between the lever element and the counterweight arrangement.

15. The crane as claimed in claim 14, wherein the coupling element is designed as a pendulum support.

16. The crane as claimed in claim 1, further comprising a counterweight guide on which the counterweight arrangement is guided during the forwardly directed change in position of the counter weight arrangement and the rearwardly directed change in position of the counterweight arrangement on the crane structure.

17. The crane as claimed in claim 1, wherein at least one coupling of two or more elements of the counterweight adjustment device comprises one or more members adapted to dampen a motion of the two or more elements with respect to each other by increasing a friction between the two or more elements so as to counteract dynamic oscillations of the counterweight adjustment device.

* * * * *